US006364283B1

(12) United States Patent
Sieber

(10) Patent No.: US 6,364,283 B1
(45) **Date of Patent: *Apr. 2, 2002**

(54) ACTUATOR UNIT WITH A DEFLECTION DEVICE

(75) Inventor: Udo Sieber, Bietigheim (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/385,683

(22) Filed: Aug. 30, 1999

(30) Foreign Application Priority Data

Sep. 2, 1998 (DE) ..... 198 39 861

(51) Int. Cl.[7] ..... F16K 31/02
(52) U.S. Cl. ..... 251/129.2
(58) Field of Search ..... 251/129.2

(56) References Cited

U.S. PATENT DOCUMENTS 977,577 A * 12/1910 Wikander ..... 251/129.2 X
1,915,822 A * 6/1933 Green ..... 251/129.2
2,609,989 A * 9/1952 Burklin ..... 251/129.2 X
3,284,044 A * 11/1966 Zaleske et al. ..... 251/129.2
4,252,296 A * 2/1981 Berg ..... 251/129.2
4,840,193 A * 6/1989 Schiel ..... 251/129.2 X

FOREIGN PATENT DOCUMENTS

| | | |
|---|---|---|
| DE | 10520 | 1/1880 |
| DE | 39501 | 10/1886 |
| DE | 83732 | 3/1894 |
| DE | 334968 | 12/1919 |
| EP | 0286389 | 4/1988 |
| GB | 1496513 | 3/1974 |
| GB | 1449780 | 1/1975 |
| GB | 1590373 | 4/1976 |
| GB | 1591421 | 1/1977 |
| GB | 2220730 A | 1/1990 |

* cited by examiner

*Primary Examiner*—Joseph A. Kaufman
*Assistant Examiner*—Eric Keasel
(74) *Attorney, Agent, or Firm*—Ronald E. Greigg

(57) ABSTRACT

The invention relates to an actuator unit, for actuating variable valve control systems having an actuator and a deflection device that deflects the motion of the actuator to a substantially linear actuating motion. In order for the actuator unit to increase the actuation dynamics the actuator is embodied as an electromagnet.

5 Claims, 1 Drawing Sheet

ACTUATOR UNIT WITH A DEFLECTION DEVICE

FIELD OF THE INVENTION

The present invention relates to an actuator unit, particularly for actuating variable valve control systems, having an actuator and a deflection device that deflects the motion of the actuator to a substantially linear actuating motion.

BACKGROUND OF THE INVENTION

Such actuator units are known in various embodiments in the prior art. For instance, it is known to embody the actuator as a hydraulic drive. The motion of the actuator is engendered in the hydraulic drive by increasing the pressure in the hydraulic medium. It is also known to provide an electric motor as the actuator, whose rotary motion is deflected to a linear actuating motion by means of a thrust rod worm gear.

These known actuator units are often used to actuate variable valve control systems in internal combustion engines, preferably to control a variable valve stroke.

The known actuator units have the disadvantage of low actuation dynamics. Because of the damping action of the hydraulic medium in an actuator embodied as a hydraulic drive or because of the inertia of the rotating masses to be accelerated in the case of an actuator embodied as an electric motor, the known actuator units have quite long actuation times.

OBJECT AND SUMMARY OF THE INVENTION

It is accordingly an object of the present invention to design and refine the actuator units of the type defined at the outset in such a way that the actuation dynamics are increased.

To attain this object, the actuator unit of the type defined at the outset is embodied as an electromagnet.

The actuator units of the invention have very high actuation dynamics, because in comparison with the known actuator units, delays caused by the damping action of a hydraulic medium or the inertia of the rotating masses of an electric motor are virtually eliminated.

According to an advantageous refinement of the present invention, the deflection device has a lever element, supported rotatably about a first pivot point, with a connecting rod rotatably connected to the lever element about a second pivot point, and the lever element is articulated by means of the armature or the electromagnet, and the connecting rod upon actuation of the electromagnet executes the substantially linear actuating motion. By means of a deflection device designed in this way, the motion of the electromagnet can be converted into a linear actuating motion. This makes it possible to dispense with complicated, high-maintenance, vulnerable deflection gears. The deflection device according to this refinement operates with especially low loss.

Advantageously, for the rotatable connection about the second pivot point, a connecting rod eyelet is embodied on a first end of the connecting rod and is connected to a correspondingly embodied counterpart of the lever element. The counter part of the lever element can for instance be embodied as a peglike round piece, which is rotatably received by the connecting rod eyelet.

In a preferred embodiment of the actuator unit of the invention, the counterpart is rotatable about the second pivot point, thereby overcoming a static friction force in the connecting rod eyelet. The static friction force acts counter to the pulsating reaction forces from the valve drive of the variable valve control system to be actuated. As a result, virtually any arbitrary setting position of the actuator unit of the invention can be maintained when there is little or no current to the electromagnet. For actuating the variable valve control systems, this embodiment requires only little actuation energy. Furthermore, the static friction that occurs in the deflection device reduces coupling vibration exerted on the actuator unit by the valve control system to be actuated. A rigid embodiment of the connecting rod reinforces this action of reducing the coupling vibration as well, because as a result the free development of the pulsating reaction forces is effectively suppressed. Because of the provisions for reducing the coupling vibration in the actuator unit, the electromagnet is widely protected against disruptive or even damaging oscillation or vibration.

Advantageously, the ratio of the spacing between the first pivot point and the second pivot point to the radius of the connecting rod eyelet is less than the coefficient of adhesion $\mu_0$ between the material of the connecting rod eyelet and the material comprising the lever element. In this case, via the connecting rod, forces introduced into the actuator unit by the variable valve control system to be actuated are compensated for by the forces of static friction in the connecting rod eyelet in such a way that they do not engender any torque with respect to the first pivot point. In this way, it is possible to successfully keep pulsating reaction forces from the valve drive away from the armature of the electromagnet.

Preferably, the second pivot point between the counterpart and the connecting rod eyelet is disposed between the first pivot point of the lever element and the first articulation point of the armature on the lever element. The longitudinal axis of the lever element extends approximately perpendicular to the substantially linear motion of the armature of the electromagnet. The longitudinal axis of the connecting rod in turn extends approximately perpendicular to the longitudinal axis of the lever element. Thus, the longitudinal axis of the connecting rod extends approximately parallel to the substantially linear motion of the armature. The connecting rod and the armature of the electromagnet are articulated on the same side of the lever element. In this way, a linear motion of the armature of the electromagnet can be deflected to a substantially oppositely oriented linear actuating motion.

By positioning the second pivot point near the first pivot point, the force of the actuating motion can be increased while the force and stroke of the armature are constant, but the length of the actuating motion is shortened. Conversely, by positioning the second pivot point farther away from the first pivot point, the length of the actuating motion can be increased, but then the force of the actuating motion becomes less. By means of a suitable positioning of the second pivot point relative to the first pivot point, the actuator unit can be adapted to applicable conditions, and in particular to the technical characteristics of the valve control system to be actuated.

In an advantageous alternative embodiment, the first pivot point of the lever element is disposed between the second pivot point between the counterpart of the connecting rod eyelet and the first articulation point of the armature on the lever element. In this embodiment, the direction of motion of the armature is deflected to an oppositely oriented actuating motion.

In another preferred embodiment, an intermediate element is disposed between the armature and the lever element. By means of this intermediate element, a deviation from a linear motion on the part of the lever element can be compensated for if the lever element is rotated about the first pivot point by the linear motion of the armature. That is, because of the rotary motion of the lever element about the first pivot point, a relative motion of the first articulation point of the lever element also occurs perpendicular to the linear motion of the armature in the direction of the first pivot point.

Advantageously, the second end of the connecting rod articulates a coupling lever of a variable valve stroke (VVH) system to a first end of the coupling lever, and the coupling lever is rotatably supported on a second end about a third pivot point. The advantages of the actuator unit of the invention are especially valuable when the actuator unit is used in VVH systems.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
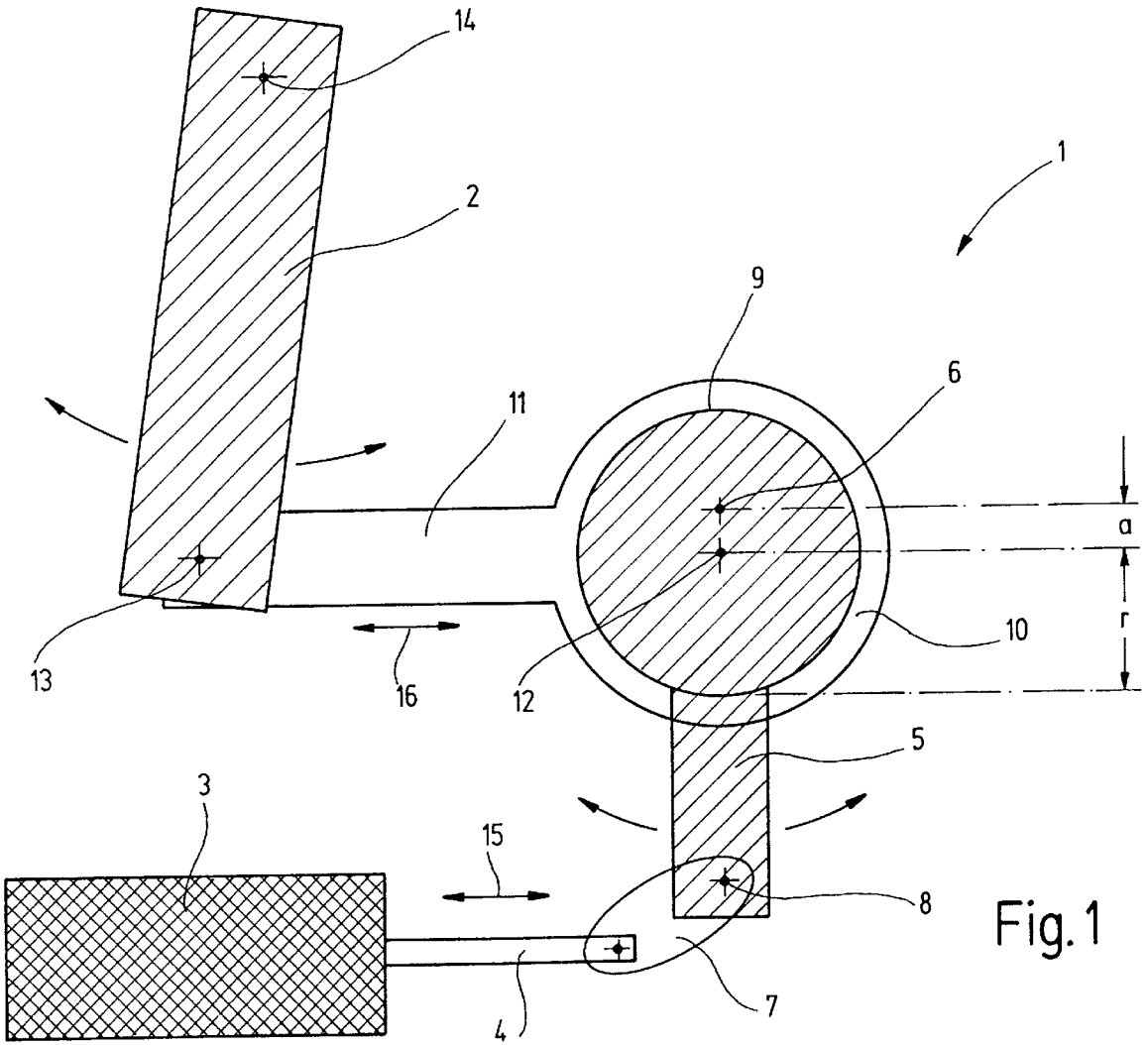
FIG. 1, shows an actuator unit according to the invention.

In FIG. 1, an actuator unit of the invention is identified in its entirety by reference numeral 1. Such an actuator unit is used for instance to actuate a variable valve control system, and in particular a variable valve stroke (VVH) system. In FIG. 1, a coupling lever, as part of a coupling gear of a VVH system, is identified by reference numeral 2.

The actuator unit 1 has an electromagnet 3 as its actuator. The electromagnet 3 has an armature 4, which is moved along a linear path of motion 15 as a result of the imposition of current on the electromagnet 3. The actuator unit 1 also has a lever element 5, which is rotatably supported about a first pivot point 6. The longitudinal axis of the lever element 5 extends approximately perpendicular to the path of motion 15 of the armature. The lever element 5 is articulated via an intermediate element 7 to the armature 4 at a first articulation point 8 spaced apart from the first pivot point 6.

The lever element 5, on its end opposite the first articulation point 8, has a peglike round piece 9, which is received rotatably in a connecting rod eyelet 10 of a connecting rod 11. The longitudinal axis of the connecting rod 11 extends approximately perpendicular to the longitudinal axis of the lever element 5. The connecting rod 11 and the intermediate element 7 are both articulated on the left-hand side of the lever element 5. The lever element 5 is rotatable about a second pivot point 12 relative to the connecting rod 11, thereby overcoming a force of static friction between the connecting rod eyelet 10 and the peglike round piece 9. The second pivot point 12 is disposed between the first pivot point 6 of the lever element 5 and the first articulation point 8 of the intermediate element 7 on the lever element 5. The first pivot point 6 is eccentric relative to the second pivot point 12 of the peglike round piece 9. Because of the eccentricity, the deflection of the lever element 5 brings about an actuating motion of the connecting rod 11 along a linear path of motion 16. As the pivot 8 of the lever element 5 moves toward the electromagnet 3, the lever element 5 pivots about the second pivot 12. Since the upper end of the lever element 5 pivots on pivot 6, the lever element 5 will cause the round piece 9 to turn to the right within the rod eyelet 10 and as the round piece 9 turns to the right, the connecting rod 11 will move linearly to the left due to the rotational movement of the round piece 9 around pivot 12. Likewise if the lever element 5 moves away from the electromagnet 3, the round piece 9 will be rotated to the left within the rod eyelet 10 so that the connecting rod 11 will move in a linear direction away from the coupling lever 2 which will then move the coupling lever 2 to the right. The connecting rod 11 is not pivoted on pivot 12; however, pivot 12 forms an axis upon which the connecting rod 11 rotates to cause a linear movement of the connecting rod 11. The end of the connecting rod 11 opposite from the connecting rod eyelet 10 is articulated to one end of the coupling lever 2 at a second articulation point 13. By means of the actuating motion of the connecting rod 11, the coupling lever is adjusted about a third pivot point 14, and the VVH system is thereby actuated.

The ratio of the spacing a between the first pivot point 6 and the second pivot point 12 to the radius r of the connecting rod eyelet 10 is selected to be less than the coefficient of adhesion $\mu_0$ between the material comprising the connecting rod eyelet 10 and the material comprising the lever element 5. As a result, the pulsating reaction forces from the coupling gear of the VVH system are not transmitted to the electromagnet 3.

The foregoing relates to a preferred exemplary embodiment of the invention, it being understood that other variants and embodiments thereof are possible within the spirit and scope of the invention, the latter being defined by the appended claims.

I claim:

1. An actuator unit for actuating a variable valve control system, comprising:

an actuator embodied as an electromagnet fixed to a structure, the electromagnet having an armature with linear movement, and a deflection device for deflecting the linear movement of the armature into an essentially linear actuation movement, the deflection device having a lever element with a cylindrical end piece with a radius (r) coupled to the armature by an intermediate element and supported by the structure so that the lever element is rotatable about a first pivot point, a connecting rod including an end eyelet rotationally surrounding the end piece of the lever element so that the eyelet is rotatable relative to the lever element about a first rotational point located a spacing (a) from the first pivot point, and the lever element is coupled to the armature of the electromagnet by an intermediate element at a second rotational point, means for constraining the connecting rod so that the motion of the connecting rod is essentially linear when the linear movement of the armature imparts a rotational movement to the lever element about the first pivot point causing the first rotational point and the cylindrical end piece to move on a circular path about the first pivot point and overcomes a static friction force with coefficient of adhesion ($\mu_0$) between the connecting rod eyelet and the cylindrical end piece to impart motion to the connecting rod through the eyelet, wherein a ratio of the spacing (a) to the radius (r) is less than the coefficient of adhesion ($\mu_0$).

2. The actuator unit according to claim 1, in which the cylindrical end piece of the lever element is embodied as an elongated peglike round piece.

3. The actuator unit according to claim 1, in which the means for constraining the motion of the connecting rod to the essentially linear actuation movement comprise a coupling lever of the variable valve control system, the coupling lever is supported so that the coupling lever is rotatable about a second pivot point fixed to the structure and the coupling lever is connected to the connecting rod at a third rotational point, the third rotational point is spaced apart from the second pivot point and from the first rotational point.

4. The actuator unit according to claim 1, in which the first rotational point is disposed between the first pivot point and the second rotational point.

5. The actuator unit according to claim 1, in which the intermediate element is disposed between the armature and the lever element.

* * * * *